US010134292B2

(12) United States Patent
Kushwaha

(10) Patent No.: US 10,134,292 B2
(45) Date of Patent: Nov. 20, 2018

(54) NAVIGATING AND GUIDING AN AIRCRAFT TO A REACHABLE AIRPORT DURING COMPLETE ENGINE FAILURE

(71) Applicant: AIRBUS GROUP INDIA PRIVATE LIMITED, Bangalore (IN)

(72) Inventor: Dinesh Kumar Kushwaha, Bangalore (IN)

(73) Assignee: AIRBUS GROUP INDIA PRIVATE LIMITED, Bangalore, Karnataka (IN)

( * ) Notice: Subject to any disclaimer, the term of this patent is extended or adjusted under 35 U.S.C. 154(b) by 34 days.

(21) Appl. No.: 15/369,938

(22) Filed: Dec. 6, 2016

(65) Prior Publication Data

US 2017/0162062 A1 Jun. 8, 2017

(30) Foreign Application Priority Data

Dec. 7, 2015 (IN) ..... 6535/CHE/2015

(51) Int. Cl.
*G08G 5/00* (2006.01)
*G08G 5/02* (2006.01)

(52) U.S. Cl.
CPC ..... *G08G 5/0056* (2013.01); *G08G 5/0021* (2013.01); *G08G 5/0039* (2013.01); *G08G 5/025* (2013.01)

(58) Field of Classification Search
None
See application file for complete search history.

(56) References Cited

U.S. PATENT DOCUMENTS

| | | | | |
|---|---|---|---|---|
| 8,467,916 | B2 * | 6/2013 | Narasimhulu | G08G 5/0056 244/175 |
| 8,543,264 | B1 * | 9/2013 | Tomas | G05D 1/105 244/142 |
| 9,257,048 | B1 * | 2/2016 | Offer | G08G 5/0021 |
| 9,310,222 | B1 * | 4/2016 | Suiter | G01C 23/005 |
| 2003/0060940 | A1 * | 3/2003 | Humbard | G01C 23/00 701/3 |
| 2008/0306680 | A1 * | 12/2008 | Marty | G01C 21/00 701/533 |
| 2010/0161156 | A1 * | 6/2010 | Coulmeau | G08G 5/0021 701/3 |
| 2011/0082605 | A1 * | 4/2011 | Coulmeau | G08G 5/045 701/14 |
| 2012/0109428 | A1 * | 5/2012 | Narasimhulu | G01S 5/0284 701/16 |

(Continued)

*Primary Examiner* — Truc M Do
(74) *Attorney, Agent, or Firm* — Prakash Nama; Global IP Services, PLLC

(57) ABSTRACT

In one example, a method to guide and navigate the aircraft during a complete engine failure is disclosed. Nearby airport data is obtained based on aircraft current location upon detecting the complete aircraft engine failure. Minimum and maximum glide distances of the aircraft are computed based on the current aircraft state parameters and environmental parameters. Candidate reachable airports are determined using the obtained nearby airport data for safe landing based on the computed minimum and maximum glide distances. A glide path for each candidate reachable airport is determined. The aircraft is navigated and guided to a selected one of the candidate reachable airports using an associated glide path.

27 Claims, 5 Drawing Sheets

(56) References Cited

U.S. PATENT DOCUMENTS

| | | | | |
|---|---|---|---|---|
| 2014/0142787 | A1* | 5/2014 | Tillotson | G05D 1/101 701/3 |
| 2014/0309821 | A1* | 10/2014 | Poux | G08G 5/0021 701/14 |
| 2014/0343765 | A1* | 11/2014 | Suiter | G08G 5/0056 701/18 |
| 2016/0229554 | A1* | 8/2016 | Kawalkar | G01C 23/005 |

* cited by examiner

NAVIGATING AND GUIDING AN AIRCRAFT TO A REACHABLE AIRPORT DURING COMPLETE ENGINE FAILURE

RELATED APPLICATION

Benefit is claimed under 35 U.S.C. 119(a)-(d) to Foreign Application Serial No. 6535/CHE/2015 filed in India entitled "NAVIGATING AND GUIDING AN AIRCRAFT TO A REACHABLE AIRPORT DURING COMPLETE ENGINE FAILURE", filed on Dec. 7, 2015 by AIRBUS GROUP INDIA PRIVATE LIMITED which is herein incorporated in its entirety by reference for all purposes.

TECHNICAL FIELD

Embodiments of the present subject matter generally relate to navigating and guiding the aircraft, and more particularly, to the navigating and guiding the aircraft to a reachable airport during complete aircraft engine failure.

BACKGROUND

During flight, aircraft engines may fail due to various factors, for example environmental conditions, mechanical issues, fuel contamination, bird strikes, volcanic ash, excessive flight idling of the aircraft engines, and the like. With complete engine failure (e.g., failure of all engines), a relatively quick determination of gliding speed, rate of descent, and aircraft configuration may be needed to maximize the gliding distance for reaching emergency landing area or airport. With loss of engine power, there are many other tasks to be performed by the pilot, including contacting air traffic control, monitoring other traffic, determining the reason for loss of engine power, for example, low fuel or mechanical malfunction, and attempting to restart the engine. With the number of tasks to perform, it may be difficult to determine and maintain the proper gliding speed for maximizing gliding distance. The range which an aircraft can glide without engine power may significantly vary based on pilot's ability to adjust airplane speed to given conditions, e.g., head wind/tail wind, vertical air flow, and turbulent weather/calm air. If the pilot does not possess enough experience with gliding the aircraft in such conditions, the incorrect setting of the gliding speed may significantly reduce gliding distance of the aircraft. This may limit the glide area where the pilot can select a field for emergency landing.

Further, when all aircraft engines fail, a precautionary landing may be needed to safe guard passengers inside the aircraft and/or the aircraft. During such precautionary landing, the pilot of the aircraft may want to land the aircraft at a nearby airport. However in such a scenario, the pilot may not be confident as to how far the aircraft may glide and also the pilot may not be sure whether the aircraft can reach the nearby airport by gliding. Therefore, the pilot may try to identify causes for the aircraft engines failure and try to restart the aircraft engines. Identifying causes of the aircraft engine failure and aircraft engine restarting may distract the pilot from gliding the aircraft which may further reduce gliding distance of the aircraft.

SUMMARY

In one embodiment, a method and system to navigate and guide the aircraft to a reachable airport during a complete aircraft engine failure is disclosed. In one aspect, nearby airport data is obtained based on aircraft current location upon detecting the complete aircraft engine failure. Minimum and maximum glide distances of the aircraft are computed based on current aircraft state parameters and environmental parameters. Candidate reachable airports are determined using the obtained nearby airport data for safe landing based on the computed minimum and maximum glide distances. A glide path for each candidate reachable airport is determined. The aircraft is navigated and guided to a selected one of the candidate reachable airports using an associated glide path.

In another embodiment, a flight management and guidance envelope computing (FMGEC) system is described. The FMGEC system may include a processor, memory coupled to the processor, and an aircraft guidance module residing in the memory. The aircraft guidance module may obtain nearby airport data based on aircraft current location upon detecting the complete aircraft engine failure. The aircraft guidance module may further compute minimum and maximum glide distances of the aircraft based on current aircraft state parameters and environmental parameters. Based on the computed minimum and maximum glide distances, the aircraft guidance module may determine candidate reachable airports using the obtained nearby airport data for safe landing. Also, the aircraft guidance module may determine a glide path for each candidate reachable airport. The aircraft guidance module may enable navigation and guidance of the aircraft to a selected one of the candidate reachable airports using an associated glide path.

Yet, in another embodiment, a non-transitory computer-readable medium is disclosed. The non-transitory computer-readable medium has computer executable instructions stored thereon for aircraft guidance and navigation. The instructions are executable by a processor to obtain nearby airport data based on aircraft current location upon detecting the complete aircraft engine failure, compute minimum and maximum glide distances of the aircraft based on current aircraft state parameters and environmental parameters, and based on the computed minimum and maximum glide distances, determine candidate reachable airports using the obtained nearby airport data for safe landing. The instructions are executable by a processor to determine a glide path for each candidate reachable airport. The aircraft may be navigated and guided to a selected one of the candidate reachable airports using an associated glide path.

BRIEF DESCRIPTION OF THE DRAWINGS

Various embodiments are described herein with reference to the drawing, wherein.

Figure 1:
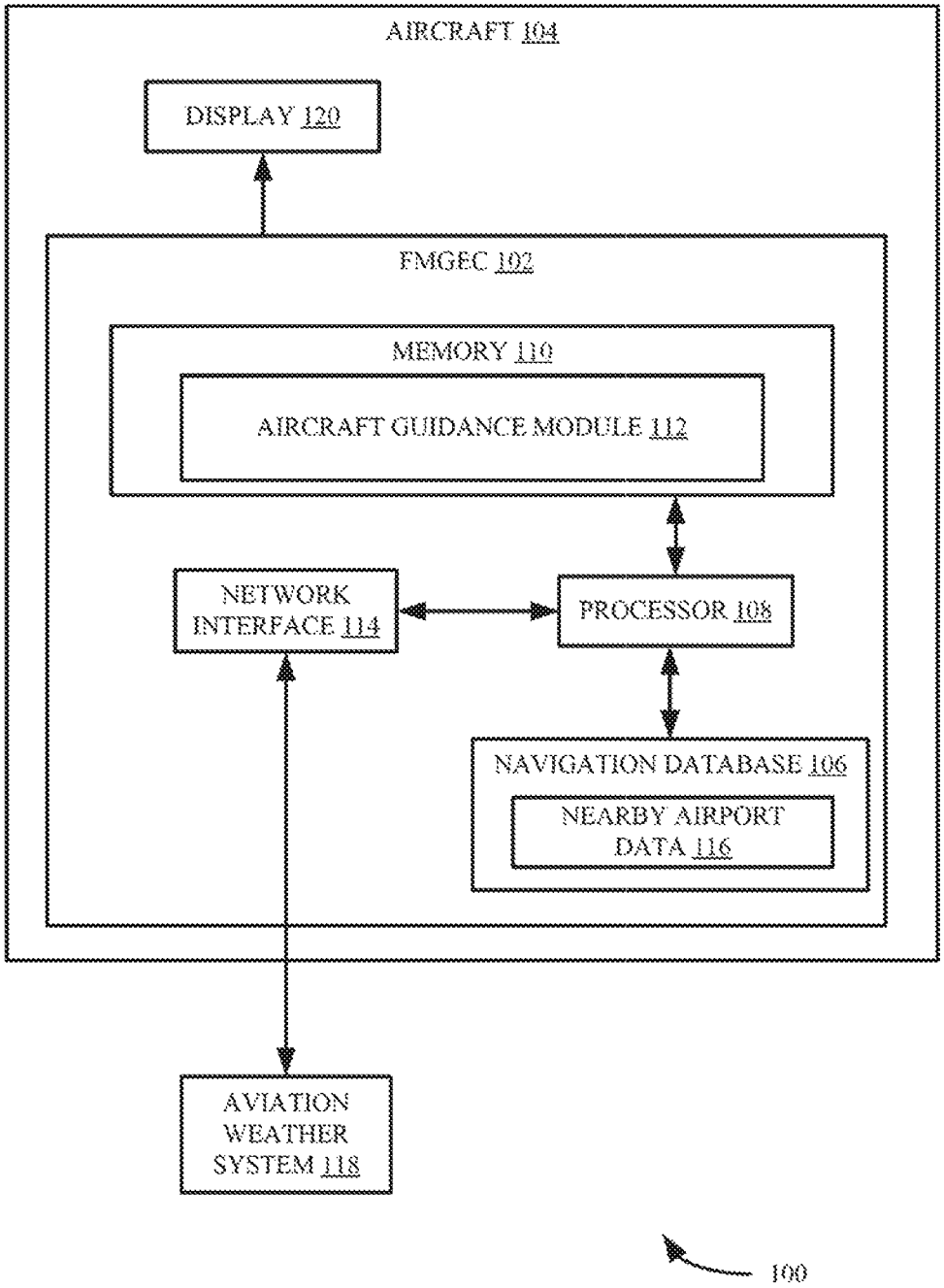
FIG. 1 is an example block diagram illustrating a flight management and guidance envelope computing (FMGEC) system disposed in an aircraft and communicating with an aviation weather system for aircraft guidance and navigation during a complete aircraft engine failure.

The drawing described herein are for illustration purposes only and are not intended to limit the scope of the present disclosure in any way.

DETAILED DESCRIPTION

In the following detailed description of the embodiments of the present subject matter, references are made to the accompanying drawings that form a part hereof, and in which are shown by way of illustration specific embodiments in which the present subject matter may be practiced. These embodiments are described in sufficient detail to enable those skilled in the art to practice the present subject matter, and it is to be understood that other embodiments may be utilized and that changes may be made without departing from the scope of the present subject matter. The following detailed description is, therefore, not to be taken in a limiting sense, and the scope of the present subject matter is defined by the appended claims.

With loss of engine power, a pilot of the aircraft may have to perform many tasks, including contacting air traffic control, monitoring other traffic, determining the reason for loss of engine power to restart the engines. With a number of tasks to be performed simultaneously, it is difficult to determine and maintain a proper gliding speed for maximizing gliding distance. Further, example method/systems may not be assisting the pilot to make a right decision during the loss of engine power. Therefore, the pilot may not be confident to glide the aircraft to a nearby airport.

The present application discloses aircraft guidance and navigation techniques in which the aircraft may be guided and navigated for safe landing of the aircraft during a complete aircraft engine failure with confidence. Therefore, improving overall safety of the aircraft and passengers inside the aircraft. The disclosed aircraft guidance and navigation techniques also reduce pilot's workload during such catastrophic emergency.

FIG. 1 illustrates a block diagram 100 showing an example flight management and guidance envelope computing (FMGEC) system 102 residing in an aircraft 104. The FMGEC system 102 may include a navigation database 106, a processor 108, and memory 110. The memory 110 may include an aircraft guidance module 112. For example, the aircraft guidance module 112 can be in the form of instructions stored in the memory 110. The FMGEC system 102 may also include a network interface 114 which may be coupled to the processor 108. The navigation database 106 may store airport data 116 which indicates details/lists of the airports along a scheduled path of the aircraft 104. The details of the airports may, for example, include airport elevation for each of the airports and airport course.

In addition, as shown in FIG. 1, the processor 108 may be communicatively coupled to an aviation weather system 118 through the network interface 114. In examples described herein, the network interface 114 may be a hardware device to communicate over at least one computer network. Example computer network may include a wireless network, such as a satellite network, aircraft data network, aeronautical telecommunications network (ATN), or the like. Moreover, as shown in FIG. 1, the aircraft 104 may include a display 120 which is coupled to the FMGEC system 102. In one example, the display 120 may include a touch screen.

During flight, when all engines of the aircraft 104 fail, the aircraft guidance module 112 may fetch/obtain nearby airport data 116 from the navigation database 106 based on aircraft current location. In one example, the aircraft current location may be determined by a Global Positioning System (GPS) disposed in the aircraft 104. Alternatively, the aircraft current location may be determined by any location determination system/device. Further, the nearby airport data 116 may be utilized to determine lists and/or other details of the airports that are near to the determined current location of the aircraft 104.

Further, the aircraft guidance module 112 may compute minimum and maximum glide distances of the aircraft 104. In one example, the minimum and maximum glide distance may be computed based on aircraft state parameters, environmental parameters, and the like. For this purpose, the environment parameters may be obtained from the aviation weather system 118 using the network interface 114 over a network channel. Example environment parameters may include speed of the wind around the aircraft 104, direction of the wind, and temperature outside the aircraft 104. For example, headwind may reduce glide distance of the aircraft 104. On the other hand, tail wind may increase the glide distance of the aircraft 104. Example current aircraft state parameters may include the current altitude of the aircraft 104, weight of the aircraft 104, and the speed of the aircraft 104 at the location where all the engines of the aircraft 104 failed.

Further, the aircraft guidance module 112 may determine candidate reachable airports using the obtained nearby airport data 116 and the computed minimum and maximum glide distances. For example, if the minimum glide distance and the maximum glide distance are computed as 40 Kms and 100 Kms respectively, the airports that fall in the range of 40 Kms to 100 Kms may be considered as candidate reachable airports.

Furthermore, the aircraft guidance module 112 may determine a glide path for each candidate reachable airport. Each glide path may include a lateral and a vertical route to an associated candidate reachable airport. In one example, the glide path for each candidate reachable airport may be determined based on safety constraints, for example altitude restrictions and presence of other aircraft along, the glide path. The altitude restrictions may be referred to as an altitude range (i.e., a maximum and a minimum altitude) under which an aircraft can glide.

Further, a confidence level for each glide path may be determined. The confidence level may indicate a level of confidence for the aircraft to safely reach the candidate reachable airports by gliding. These glide paths, associated candidate airports and the associated confidence level may be presented provided to the crew members, for example, on the display 120. The crew members may select one of the candidate airports for safely gliding the aircraft 104 to the selected candidate airport. For example, the pilot/crew member may select the candidate reachable airport and associated glide path having a comparably high confidence level. In one example, the aircraft guidance module 112 may facilitate the crew member to manually navigate and guide the aircraft 104 to the selected candidate airport. In another example, the guidance module 112 may automatically navigate and guide the aircraft 104 to the selected candidate airport using an auto pilot system of the aircraft 104.

Figure 2:
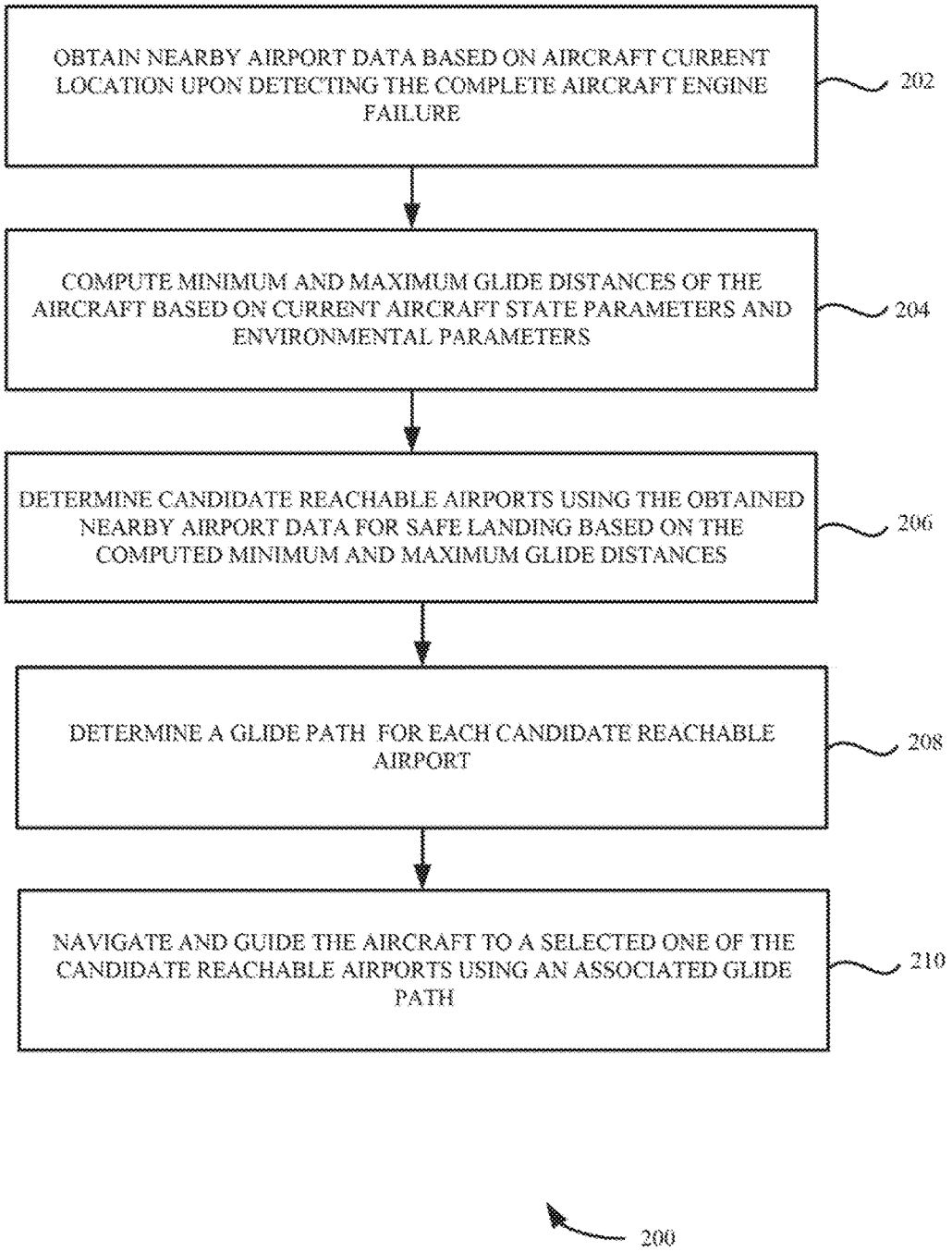
FIG. 2 is an example flow diagram showing a method to guide and navigate the aircraft during a complete engine failure.

Referring now to FIG. 2 which illustrates an example flow diagram showing a method to guide and navigate the aircraft during a complete engine failure. At block 202, nearby airport data may be obtained based on aircraft current location upon detecting the complete aircraft engine failure. The navigation airport data may be obtained from a navigation database.

At block 204, minimum and maximum glide distances of the aircraft are computed based on current aircraft state parameters and environmental parameters. Example environment parameters may include speed of the wind around the aircraft, direction of the wind, and temperature outside the aircraft. Example aircraft state parameters may include the altitude of the aircraft at a location where all engines of the aircraft failed, weight of the aircraft, and the speed of the aircraft at the location where all the engines of the aircraft failed.

At block 206, candidate reachable airports may be determined using the obtained nearby airport data for safe landing based on the computed minimum and maximum glide distances. At block 208, a glide path for each candidate reachable airport is determined. In one example, the glide path for each candidate reachable airport may be determined based on the safety constraints, for example altitude restriction.

At block 210, the aircraft is guided and navigated to a selected one of the candidate reachable airports using an associated glide path. In one example, a confidence level, to reach the candidate reachable airports by gliding the aircraft, is determined for each glide path. The determined candidate reachable airports and associated glide paths along with an associated confidence level are provided to crew members. Further, the crew members are allowed to select one of the candidate reachable airports.

Figure 3:
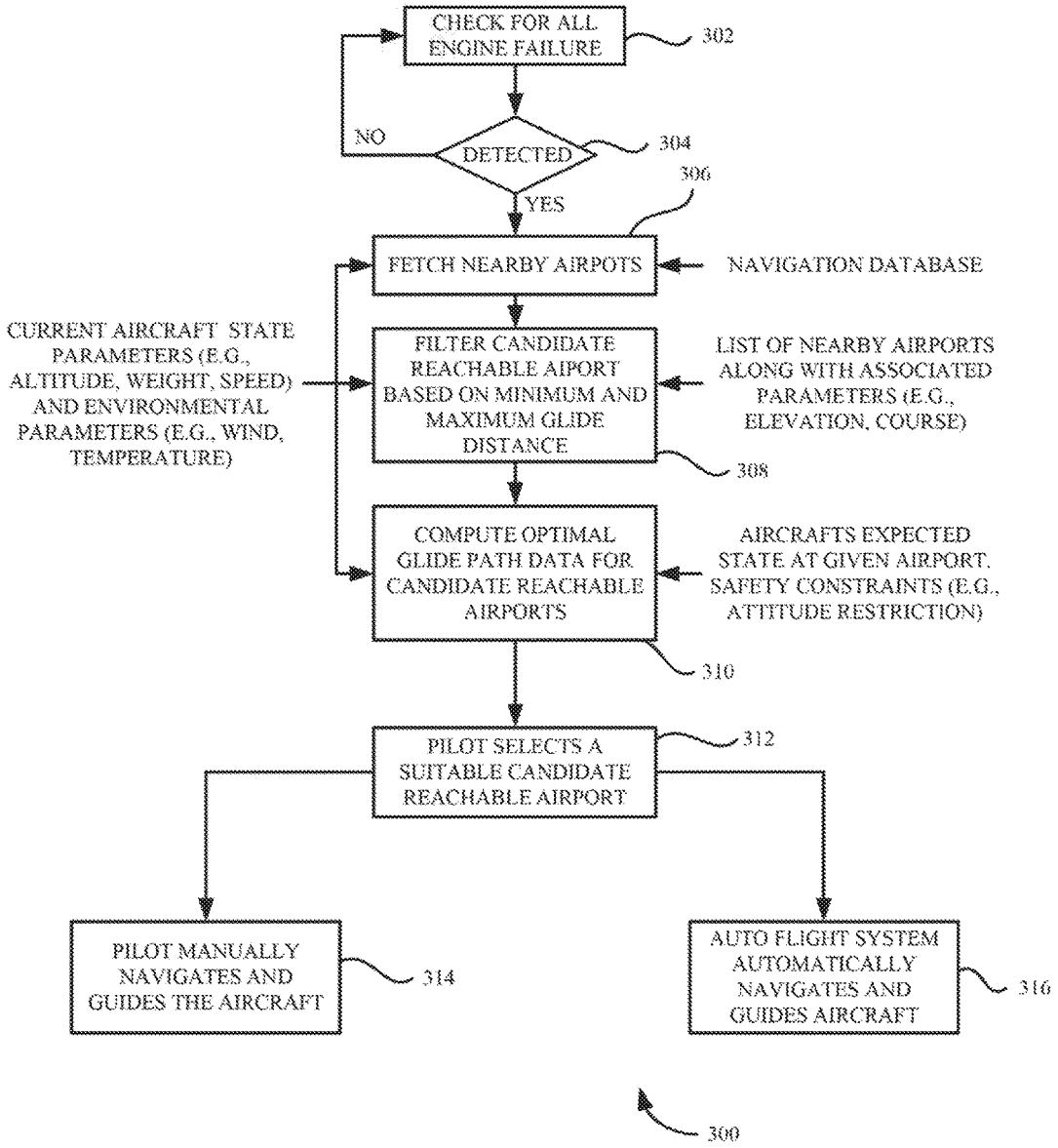
FIG. 3 is an example flow diagram with additional steps showing a method to guide and navigate the aircraft during a complete engine failure.

FIG. 3 is example flow diagram showing a method to guide and navigate the aircraft during a complete engine failure with additional steps. First at block 302, all aircraft engine failure is checked. If all engine failure is detected at step 304, nearby airports are fetched from the navigation database at step 306. Then at step 308, candidate reachable airports are filtered from the list of nearby airports based on current aircraft state parameters, environmental parameters and minimum and maximum glide distance. After filtering the candidate reachable airports, an optimal glide path for each candidate reachable airport is determined based on aircrafts expected state at given airport and safety constraints such as attitude restriction.

At block 310, the optimal glide path along with the associated candidate reachable airport is provided to the crew member. At block 312, the crew member may select a suitable candidate reachable airport for navigating and guiding the aircraft to the selected candidate reachable airport. At block 314, the aircraft may be manually navigated and guide to the selected candidate reachable airport when manual pilot option is selected. At block 316, the aircraft may be automatically navigated and guided to the selected candidate reachable airport when an auto pilot option is selected.

Figure 4:
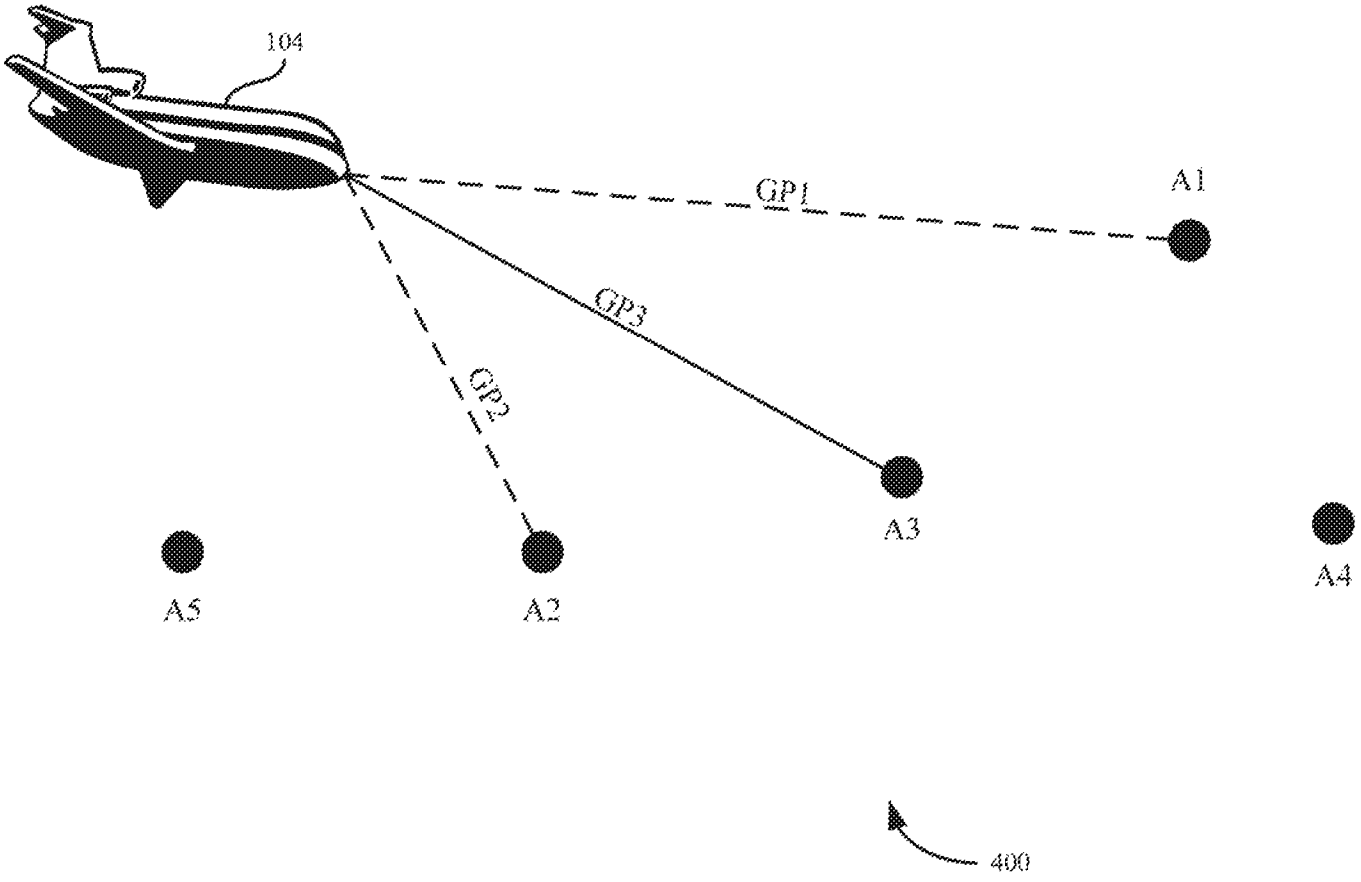
FIG. 4 is an example schematic illustrating a selected glide path to guide and navigate the aircraft during the complete engine failure.

FIG. 4 is an example schematic which illustrates a selected glide path to guide and navigate the aircraft during a complete engine failure. In the present example, nearby airport data may be obtained from a navigation database when the complete aircraft engine failure is detected. The nearby airport data may be obtained based on aircraft current location. The nearby airport data may be used to determine nearby airports (e.g., A1, A2, A3, A4, and A5 as shown in FIG. 4) to the aircraft 104. Further, minimum and maximum glide distances of the aircraft 104 are computed based on the aircraft state parameters and the environmental parameters. Furthermore, candidate reachable airports (e.g., A1, A2, and A3, as shown in FIG. 4) may be determined using the obtained nearby airport data for safe landing based on the computed minimum and maximum glide distances. For each candidate reachable airport, a glide path is determined. For example, as shown in FIG. 4, glide path GP1 is determined for airport A1, glide path GP2 is determined for airport A2, and glide path GP3 is determined for airport A3. Then, glide paths (GP1, GP2, and GP3) along with the candidate reachable airports (A1, A2, and A3) may be presented to the pilot/crew member to select a suitable candidate reachable airport to safely land the aircraft 104 to the suitable candidate airport. For example, as shown in FIG. 4, the pilot may select the airport A3 and associated glide path GP3 for landing the aircraft 104. The aircraft 104 may be guided and navigated to the selected the candidate reachable airport A3 using the associated glide path GP3.

Figure 5:
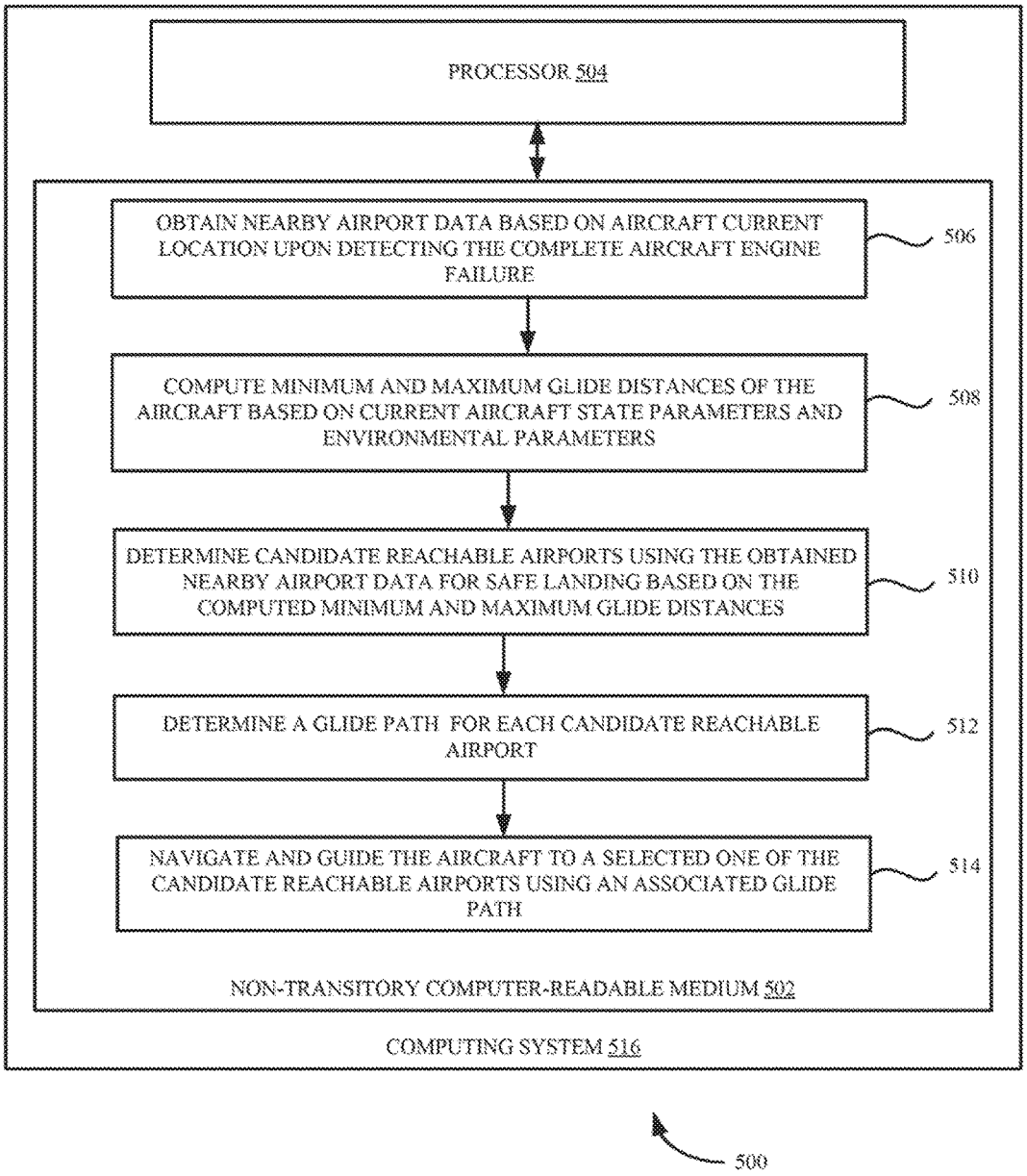
FIG. 5 is an example block diagram showing a non-transitory computer-readable medium for aircraft guidance and navigation during a complete aircraft engine failure.

FIG. 5 is an example block diagram 500 showing a non-transitory computer-readable medium 502 that stores code for operation in accordance with an example of the techniques of the present application. The non-transitory computer-readable medium 502 may be included in a computing system 516. The computing system 516 may be the FMGEC system 102 as shown in FIG. 1. The non-transitory computer-readable medium 502 may correspond to any storage device that stores computer-implemented instructions, such as programming code or the like. For example, the non-transitory, computer-readable medium 502 may include non-volatile memory, volatile memory, and/or storage devices. Examples of non-volatile memory include, but are not limited to, electrically erasable programmable Read Only Memory (EEPROM) and Read Only Memory (ROM). Examples of volatile memory include, but are not limited to, Static Random Access Memory (SRAM), and dynamic Random Access Memory (DRAM). Examples of storage devices include, but are not limited to, hard disk drives, compact disc drives, digital versatile disc drives, optical drives, and flash memory devices.

A processor 504 generally retrieves and executes the instructions stored in the non-transitory computer-readable medium 502 to operate the present techniques in accordance with an example. In one example, the tangible, non-transitory computer-readable medium 502 can be accessed by the processor 504 over a bus.

For example, block 506 provides instructions which may include instructions to obtain nearby airport data based on aircraft current location upon detecting the complete aircraft engine failure.

For example, block 508 provides instructions which may include instructions to compute minimum and maximum glide distances of the aircraft based on aircraft state parameters, and environmental parameters. Example environment parameters may include speed of the wind around the aircraft, direction of the wind, and temperature outside the aircraft. Example aircraft state parameters may include the altitude of the aircraft at a location where all engines of the aircraft failed, weight of the aircraft, and the speed of the aircraft at the location where all the engines of the aircraft failed.

For example, block 510 provides instructions which may include instructions to determine candidate reachable airports using the obtained nearby airport data for safe landing based on the computed minimum and maximum glide distances.

For example, block 512 provides instructions which may include instructions to determine a glide path for each candidate reachable airport. In one example, the glide path for each candidate reachable airport may be determined based on the safety constraints, for example altitude restriction.

For example, block 514 provides instructions which may include instructions to guide and navigate the aircraft to a selected one of the candidate reachable airports and associated glide path.

Although shown as contiguous blocks, the machine readable instructions can be stored in any order or configuration. For example, if the non-transitory computer-readable medium 502 is a hard drive, the machine readable instructions can be stored in non-contiguous, or even overlapping sectors.

As used herein, the processor 504 may include processor resources such as at least one of a Central Processing Unit (CPU), a semiconductor-based microprocessor, a Graphics Processing Unit (GPU), a Field-Programmable Gate Array (FPGA) to retrieve and execute instructions, other electronic circuitry suitable for the retrieval and execution instructions stored on a computer-readable medium, or a combination thereof. The processor 504 fetches, decodes, and executes instructions stored on the non-transitory computer-readable medium 502 to perform the functionalities described below. In other examples, the functionalities of any of the instructions of the non-transitory computer-readable medium 502 may be implemented in the form of electronic circuitry, in the form of executable instructions encoded on a computer-readable storage medium, or a combination thereof.

As used herein, the non-transitory computer-readable medium 502 may be any electronic, magnetic, optical, or other physical storage apparatus to contain or store information such as executable instructions, data, and the like. For example, any computer-readable storage medium described herein may be any of Random Access Memory (RAM), volatile memory, non-volatile memory, flash memory, a storage drive (e.g., a hard drive), a solid state drive, any type of storage disc (e.g., a compact disc, a DVD, etc.), and the like, or a combination thereof. Further, any computer-readable medium described herein may be non-transitory. In examples described herein, the computer-readable medium or media is part of an article (or article of manufacture). An article or article of manufacture may refer to any manufactured single component or multiple components. The medium may be located either in the system executing the computer-readable instructions, or remote from but accessible to the system (e.g., via a computer network) for execution. In the example of FIG. 5, the non-transitory computer-readable medium 502 may be implemented by one computer-readable medium, or multiple computer-readable media.

In examples described herein, the host/client device may communicate with components implemented on separate devices or system(s) via a network interface device of the host. For example, the host/client device may communicate with the FMGEC system 102 via a network interface device 114 of the host/client device. In examples described herein, a "network interface device" may be a hardware device to communicate over at least one computer network. In some examples, a network interface may be a Network Interface Card (NIC) or the like. As used herein, a computer network may include, for example, a Local Area Network (LAN), a Wireless Local Area Network (WLAN), a Virtual Private Network (VPN), the Internet, or the like, or a combination thereof. In some examples, a computer network may include a telephone network (e.g., a cellular telephone network).

In some examples, instructions may be part of an installation package that, when installed, may be executed by processor 504 to implement the functionalities described herein in relation to instructions. In such examples, the non-transitory computer-readable medium 502 may be a portable medium, such as a CD, DVD, or flash drive, or a memory maintained by a server from which the installation package can be downloaded and installed. In other examples, instructions may be part of an application, applications, or component(s) already installed on the computing system 516 including processor 504. In such examples, the non-transitory computer-readable medium 502 may include memory such as a hard drive, solid state drive, or the like. In some examples, functionalities described herein in relation to FIGS. 1 through 5 may be provided in combination with functionalities described herein in relation to any of FIGS. 1 through 5.

Although certain methods, systems, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. A method of navigating and guiding an aircraft during a complete engine failure, comprising:

obtaining nearby airport data based on aircraft current location upon detecting the complete aircraft engine failure;

computing minimum and maximum glide distances of the aircraft based on current aircraft state parameters and environmental parameters;

determining candidate reachable airports using the obtained nearby airport data for safe landing based on the computed minimum and maximum glide distances;

determining a glide path for each candidate reachable airport;

determining a confidence level, to reach the candidate reachable airports by gliding the aircraft, for each glide path; and navigating and guiding the aircraft to a selected one of the candidate reachable airports using an associated glide path, wherein the one of the candidate reachable airports is selected based on the confidence level of each glide path.

2. The method of claim 1, wherein navigating and guiding the aircraft to the selected one of the candidate reachable airports comprises:

providing the determined candidate reachable airports and associated glide paths along with an associated confidence level to crew members;

enabling the crew members to select the one of the candidate reachable airports based on the associated confidence level; and navigating and guiding the aircraft to the selected one of the candidate reachable airports using the associated glide path.

3. The method of claim 1, wherein the nearby airport data is obtained from a navigation database.

4. The method of claim 1, wherein each glide path comprises a lateral route and a vertical route to an associated candidate reachable airport.

5. The method of claim 1, wherein the nearby airport data comprises list of nearby airports and associated airport parameters.

6. The method of claim 5, wherein the associated airport parameters comprise airport elevation and airport course.

7. The method of claim 1, wherein the current aircraft state parameters are selected from the group consisting of altitude of the aircraft, weight of the aircraft, and speed of the aircraft.

8. The method of claim 1, wherein the environmental parameters are selected from the group consisting of speed of wind, direction of the wind, and environmental temperature.

9. The method of claim 1, wherein the glide path for each candidate reachable airport is determined based on safety constraints.

10. The method of claim 9, wherein the safety constraints are selected from the group consisting of altitude restriction and presence of other aircraft along the glide path.

11. The method of claim 1, wherein the aircraft is manually navigated and guided to the selected one of the candidate reachable airports based on the associated glide path.

12. The method of claim 1, wherein the aircraft is automatically navigated and guided to the selected one of the candidate reachable airports based on the associated glide path.

13. A flight management and guidance envelope computing (FMGEC) system, comprising:

a processor;

memory coupled to the processor; and an aircraft guidance module residing in the memory to:

obtain nearby airport data based on aircraft current location upon detecting a complete aircraft engine failure;

compute minimum and maximum glide distances of the aircraft based on current aircraft state parameters and environmental parameters;

determine candidate reachable airports using the obtained nearby airport data for safe landing based on the computed minimum and maximum glide distances;

determine a glide path for each candidate reachable airport;

determine a confidence level, to reach the candidate reachable airports by gliding the aircraft, for each glide path; and navigate and guide the aircraft to a selected one of the candidate reachable airports using an associated glide path, wherein the one of the candidate reachable airports is selected based on the confidence level of each glide path.

14. The FMGEC system of claim 13, wherein the aircraft guidance module navigates and guides the aircraft to the selected one of the candidate reachable airports by:

providing the determined candidate reachable airports and associated glide paths along with an associated confidence level to crew members;

enabling the crew members to select the one of the candidate reachable airports based on the associated confidence level; and navigating and guiding the aircraft to the selected one of the candidate reachable airports using the associated glide path.

15. The FMGEC system of claim 13, wherein each glide path comprises a lateral route and a vertical route to an associated candidate reachable airport.

16. The FMGEC system of claim 13, wherein the nearby airport data comprises list of nearby airports and associated airport parameters.

17. The FMGEC system of claim 16, wherein the associated airport parameters comprise airport elevation and airport course.

18. The FMGEC system of claim 13, wherein the current aircraft state parameters are selected from the group consisting of altitude of the aircraft, weight of the aircraft, and speed of the aircraft.

19. The FMGEC system of claim 13, wherein the environmental parameters are selected from the group consisting of speed of wind, direction of the wind, and environmental temperature.

20. The FMGEC system of claim 13, wherein the glide path for each candidate reachable airport is determined based on safety constraints.

21. The FMGEC system of claim 20, wherein the safety constraints are selected from the group consisting of altitude restriction and presence of other aircraft along the glide path.

22. The FMGEC system of claim 13, further comprising a navigation database, wherein nearby airport data is obtained based on the aircraft current location from the navigation database.

23. A non-transitory computer-readable medium having computer executable instructions stored thereon for navigating and guiding an aircraft during a complete engine failure, the instructions are executable by a processor to:

obtain nearby airport data based on aircraft current location upon detecting the complete aircraft engine failure;

compute minimum and maximum glide distances of the aircraft based on current aircraft state parameters and environmental parameters;

determine candidate reachable airports using the obtained nearby airport data for safe landing based on the computed minimum and maximum glide distances;

determine a glide path for each candidate reachable airport;

determine a confidence level, to reach the candidate reachable airports by gliding the aircraft, for each glide path; and navigate and guide the aircraft to a selected one of the candidate reachable airports using an associated glide path, wherein the one of the candidate reachable airports is selected based on the confidence level of each glide path.

24. The non-transitory computer-readable medium of claim 23, wherein the current aircraft state parameters are selected from the group consisting of altitude of the aircraft, weight of the aircraft, and speed of the aircraft.

25. The non-transitory computer-readable medium of claim 23, wherein the environmental parameters are selected from the group consisting of speed of wind, direction of the wind, and environmental temperature.

26. The non-transitory computer-readable medium of claim 23, wherein the glide path for each candidate reachable airport is determined based on safety constraints.

27. The non-transitory computer-readable medium of claim 23, wherein navigating and guiding the aircraft to the selected one of the candidate reachable airports comprises:

providing the determined candidate reachable airports and associated glide paths along with an associated confidence level to crew members;

enabling the crew members to select the one of the candidate reachable airports based on the associated confidence level; and navigating and guiding the aircraft to the selected one of the candidate reachable airports using the associated glide path.

* * * * *